United States Patent [19]

Bellinger et al.

[11] 4,322,225

[45] Mar. 30, 1982

[54] NATURAL GAS PROCESSING

[75] Inventors: Robert M. Bellinger; Michael L. Gray, both of Bartlesville, Okla.

[73] Assignee: Phillips Petroleum Company, Bartlesville, Okla.

[21] Appl. No.: 203,922

[22] Filed: Nov. 4, 1980

[51] Int. Cl.[3] ..... B01D 35/00

[52] U.S. Cl. ..... 55/27; 55/48; 55/55

[58] Field of Search ..... 55/25, 27, 44, 55, 57, 55/48

[56] References Cited

U.S. PATENT DOCUMENTS

| | | | |
|---|---|---|---|
| Re. 16,052 | 4/1925 | Schill et al. | 55/27 X |
| 2,663,669 | 12/1953 | Barnes | 55/27 X |
| 2,821,502 | 1/1958 | Gillett et al. | 55/27 X |

*Primary Examiner*—John Adee

[57] ABSTRACT

In accordance with the present invention a normally gaseous feed mixture, having a temperature of essentially atmospheric temperature and a pressure substantially above atmospheric pressure, is cooled to a lower temperature sufficient to liquefy a portion of the feed mixture, the cooled feed mixture is separated into a first vapor phase and a first liquid phase, the first vapor phase is further cooled to a temperature sufficiently low to liquefy a portion of the first vapor phase, the cooled first vapor phase is separated into a second vapor phase and a second liquid phase, the pressures of the first liquid phase and the second liquid phase are separately reduced to a pressure sufficiently low to flash portions of the liquid phases, the reduced-pressure, first liquid phase is introduced into the lower portion of a third separation step while the reduced-pressure, second liquid phase is introduced into the upper portion of the third separation step, in which the reduced-pressure, first and second liquid phases are simultaneously separated to produce a third vapor phase and a third liquid phase, at least a portion of the second vapor phase is expanded to a pressure approximately the same as the reduced pressures of the first and second liquid phases but sufficiently low to liquefy a portion of the second vapor phase, the expanded second vapor phase, the remaining portion of the second vapor phase, if any, and the third vapor phase are introduced into the upper portion of a fourth separation step and the third liquid phase is introduced into the fourth separation step at a point below the previously mentioned upper portion of the fourth separation step and the streams introduced into the fourth separation step are simultaneously separated to produce a fourth liquid product enriched in higher boiling components and a fourth vapor product enriched in lower boiling components.

29 Claims, 1 Drawing Figure

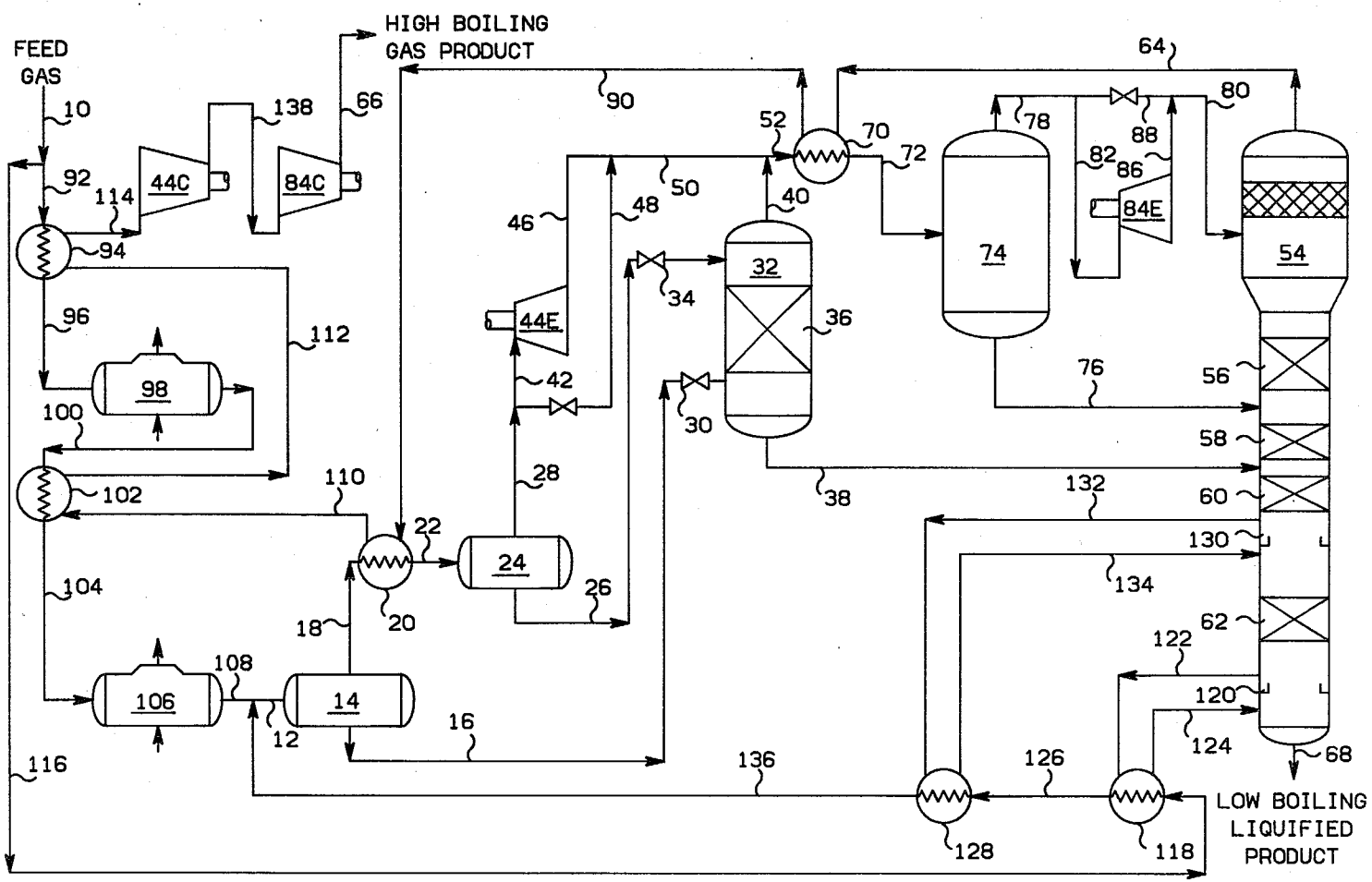
FEED GAS
HIGH BOILING GAS PRODUCT
LOW BOILING LIQUIFIED PRODUCT
54
74
32
24
14
84E
44E
84C
44C
98
106
118
128

NATURAL GAS PROCESSING

BACKGROUND OF THE INVENTION

The present invention relates to the separation of higher boiling constituents from lower boiling constituents of a mixture thereof. More specifically the present invention relates to the separation of higher molecular weight hydrocarbons from lower molecular weight hydrocarbons of a natural gas feed. In a more specific embodiment, the present invention relates to the separation of ethane and higher molecular weight components from methane of a natural gas feed.

The problems associated with prior art systems for separating higher and lower boiling constituents of a mixture thereof is best illustrated by the separation of natural gas. Natural gas as it is received from a subsurface formation generally is not suitable for use directly without some processing. The initial processing operations carried out in a natural gas plant are to first remove acid gases, such as $CO_2$ and $H_2S$, and then pass the gas through a dehydration system to remove water. The resulting product can then be used as a fuel. However, such natural gases generally contain significant amounts of higher molecular weight components, such as ethane and, to a lesser extent, propane, butanes, and higher molecular weight hydrocarbons. The ethane and higher molecular weight hydrocarbons contribute relatively little heating value to the natural gas and have a significantly greater value as chemical feedstocks than as a fuel.

The natural gas feed to a natural gas plant will generally be at about atmospheric temperature and at an elevated pressure substantially above atmospheric pressure. Therefore, it has long been known to separate ethane and higher molecular weight hydrocarbons from methane by a combination of a plurality of cooling stages and an expansion stage and separating the cooled and expanded fluid in a demethanizer to produce a vapor stream substantially higher in methane content than the original gas and a liquid stream substantially higher in ethane and higher in hydrocarbons than the original gas. However, such systems are not particularly efficient. Accordingly, it has also been proposed, in the past, to improve the efficiency by utilizing two or more expansion stages in series. Even with multiple expansion stages in series, separation is still inefficient and difficult. First, the demethanizer either must be rather large and/or a given size demethanizer is limited in its throughput capacity. Secondly, the amounts of ethane retained in the separated methane stream is higher than desirable. Finally, even with multiple expansion stages, the energy generated by the expanders is usually inadequate to handle all of the pressure requirements and the refrigeration needs of the overall plant.

SUMMARY OF THE INVENTION

It is therefore an object of the present invention to overcome the above mentioned and other problems of the prior art. Another object of the present invention is to provide an improved method and apparatus for separating higher boiling constituents from lower boiling constituents of a mixture thereof. Yet another object of the present invention is to provide an improved method and apparatus for separating ethane and higher molecular weight hydrocarbons from lower molecular weight hydrocarbons of a normally gaseous hydrocarbon stream. A further object of the present invention is to provide an improved method and apparatus for the separation of ethane and higher molecular weight hydrocarbons from a natural gas feed containing methane and said ethane and higher molecular weight hydrocarbons. Another and further object of the present invention is to provide an improved method and apparatus for separating higher molecular weight hydrocarbons from lower molecular weight hydrocarbons of a normally gaseous hydrocarbon stream by cyrogenic means. Yet another object of the present invention is to provide an improved method and apparatus for separating higher molecular weight hydrocarbons from lower molecular weight hydrocarbons of a hydrocarbon stream by a combination of cryogenic and expansion means. Another and further object of the present invention is to provide an improved method and apparatus for separating higher molecular weight hydrocarbons from lower molecular hydrocarbons of a normally gaseous hydrocarbon feed in which the size of the separation means can be substantially reduced and/or the throughput of a given size separating means can be increased. A still further object of the present invention is to provide an improved method and apparatus for separating ethane and higher molecular weight hydrocarbons from methane of a normally gaseous hydrocarbon feed in which the volume of ethane retained in the separated methane is significantly reduced. Another object of the present invention is to provide an improved method and apparatus for separating higher molecular weight hydrocarbons from lower molecular weight hydrocarbons by a combination of cryogenic and expansion means in which the energy produced by the expansion means is substantially improved. These and other objects and advantages of the present invention will be apparent from the following description.

In accordance with the present invention a normally gaseous feed mixture, having a temperature of essentially atmospheric temperature and a pressure substantially above atmospheric pressure, is cooled to a lower temperature sufficient to liquify a portion of the feed mixture, the cooled feed mixture is separated into a first vapor phase and a first liquid phase, the first vapor phase is further cooled to a temperature sufficiently low to liquefy a portion of the first vapor phase, the cooled first vapor phase is separated into a second vapor phase and a second liquid phase, the pressures of the first liquid phase and the second liquid phase are separately reduced to a pressure sufficiently low to flash portions of the liquid phases, the reduced pressure first liquid phase is introduced into the lower portion of a third separation step while the reduced pressure second liquid phase is introduced into the upper portion of the third separation step in which the reduced pressure first and second liquid phases are simultaneously separated to produce a third vapor phase and a third liquid phase, at least a portion of the second vapor phase is expanded to a pressure approximately the same as the pressures of the first and second liquid phases and sufficiently low to liquefy a portion of the second vapor phase, the expanded second vapor phase, the remaining portion of the second vapor phase, if any, and the third vapor phase are introduced into the upper portion of a fourth separation step and the third liquid phase is introduced into the fourth separation step at a point below the previously mentioned upper portion of the fourth separation step and the streams introduced into the fourth separation step are simultaneously separated to produce a vaporous product enriched in lower boiling components and a liquid product enriched in higher boiling components. In another embodiment, the expanded portion of the second vapor phase, any remaining portion of the second vapor phase and the third vapor phase are further cooled to a temperature sufficiently low to liquefy a part of said combined phases, the cooled, combined phases are further separated into a fifth vapor phase and a fifth liquid phase, the fifth vapor phase is expanded to a pressure sufficiently low to liquefy a portion of the fifth vapor phase, and the expanded portion of the fifth vapor phase and any remaining portion of the fith vapor phase are introduced into the fourth separation step near the top thereof and the fifth liquid phase is introduced between the point of introduction of the fifth vapor phase and the point of introduction of the third liquid phase.

BRIEF DESCRIPTION OF THE DRAWING

The single FIGURE of drawings is a schematic illustration of a natural gas plant which can be employed in the practice of one embodiment of the present invention.

DESCRIPTION OF THE PREFERRED EMBODIMENTS

The method and apparatus of the present invention can be best illustrated by a description with reference to the drawing which shows a preferred embodiment of the present invention.

In accordance with the drawing, a normally gaseous feed is introduced to the system through line 10. The normally gaseous feed is preferably a hydrocarbon gas and in a still more preferred embodiment a natural gas feed containing methane and ethane and higher boiling hydrocarbons which are to be separated from the methane. Generally, a natural gas feed will also contain limited amounts of nitrogen which are separated along with the methane. Usually, the feed gas will have been treated to remove acid gases and moisture.

The feed gas will generally be at a temperature approximately equal to atmospheric temperature and at an elevated pressure. For example, a natural gas feed may be at a pressure between about 100 and 5000 psia. The feed gas if first subjected to cooling in a first stage (which will be described in detail with reference to another embodiment of the present invention) at a temperature which is sufficiently low to liquify a portion of the feed gas. The cooled and partially liquefied feed gas is then passed through line 12 to a first separation step in separator 14. Separator 14 is adapted to separate the cooled feed gas into a first liquid stream, which is discharged through line 16, and a first vapor stream, which is discharged through line 18. The first vapor stream from line 18 is then subjected to a second cooling stage, in indirect heat exchanger 20. Cooling in heat exchanger 20 cools the first vapor stream to a temperature sufficiently low to liquefy a portion of the first vapor stream. The cooled first vapor stream is then passed through line 22 to a second separation step, in separator 24. Separator 24 is adapted to separate the cooled first vapor stream into a second liquid stream, which is discharged though line 26, and a second vapor stream, which is discharged through line 28. The first liquid stream, passing through line 16, is reduced in pressure to a second elevated pressure substantially above atmospheric pressure but sufficiently low to flash a portion of the first liquid stream. This reduction in pressure is carried out by passage through pressure reducing valve 30. The first liquid stream, at the second reduced pressure, is separated in a second separation step, in separator 32, by introducing the same into separator 32, at lower portion of the separation step. The second liquid stream passing through line 26 is also reduced in pressure to a pressure substantially above atmospheric pressure, approximately equal to the reduced pressure of the first liquid stream but sufficiently low to flash a portion of the second liquid stream. This reduction in pressure is carried out by passage through expansion valve 34. The reduced-pressure second liquid stream is subjected to separation by introducing it at an upper portion of the separation step carried out in separator 32. As is apparent from the drawing and description, separator 32 is a vertical tower means in which the vapor separating from the reduced-pressure first liquid rises through the separator and countercurrently contacts the downwardly moving liquids separating from the reduced-pressure second liquid stream. Preferably, the vapors separating from the reduced-pressure first liquid stream and the liquids separating from the reduced-pressure second liquid stream are passed over an extended contact surface while they are countercurrently contacting one another. While the extended contact surface may be a plurality of tray-type contact surfaces, in the preferred embodiment the extended contact surface is a packing 36. A third liquid stream, separated from the reduced-pressure first liquid stream and the reduced-pressure second liquid stream, is discharged from separator 32 through line 38. A third vapor stream, separated from the reduced-pressure first liquid stream and the reduced-pressure second liquid stream in separator 32 is withdrawn and discharged through line 40. At least a portion of the second vapor stream passing through line 28 is passed through line 42 to a first expansion stage in which this second vapor stream is expanded to a fourth elevated pressure, substantially above atmospheric pressure, approximately equal to the pressure of the reduced-pressure first liquid stream and the reduced-pressure second liquid stream and sufficiently low to liquefy a portion of the expanded portion of the second vapor stream. The expansion of the portion of the second vapor stream is carried out by passage through turbo-expander 44E. The expanded portion of the second vapor stream is discharged from expander 44E through line 46. The remaining portion, if any, of the second vapor phase, which is unexpanded, bypasses expander 44E through line 48. The expanded portion of the second vapor stream and the unexpanded portion, if any, of the second vapor stream from lines 46 and 48, respectively, are combined in line 50. The recombined stream of the second vapor phase in line 50 is then further combined with the third vapor stream in line 52. In some cases, the combined second vapor stream and third vapor stream may be passed directly to the upper portion of a fourth separation step while the third liquid stream is introduced into the same fourth separation step at a point below the point of introduction of the composite stream of the recombined second vapor stream and the third vapor stream. The fourth separation step is carried out in separator 54. Separator 54 is, of course, a vertically-disposed separator, and, more specifically, a demethanizer unit when the feed gas is a natural gas contaning methane, ethane and higher hydrocarbons and methane is to be separated from the ethane and higher hydrocarbons. In demethanizer 54, the vapors separating from the third liquid stream rise through the column and countercurrently contact liquids separating from the second and third vapor streams which descend through the column. Column 54 is also preferably provided with extended contact surfaces at least between the point of introduction of the third liquid stream and the point or points of introduction of the recombined second and the third vapor streams. The extended contact surfaces may be a plurality of trays or a combination of trays and packing means or preferably packing sections 56 and 58, respectively. A similar packed section 60 and 62 may be provided below the point of introduction of the third liquid stream in tower 54. In tower 54 the recombined second and third vapor stream and the third liquid stream are separated to produce a fourth vapor stream which is discharged through line 64, and is eventually recovered as a product (herein referred to as a residue gas product) through line 66. The residue gas will have a substantially increased methane content as compared with the original feed gas and is suitable for use as a fuel. The residue gas may also contain small amounts of nitrogen which, if any, is present in the feed gas. In any event, the residue gas may be utilized as pipeline gas for domestic purposes or a part thereof may be utilized in the plant itself as a source of energy for operation of compressors, pumps, etc. Liquids separated from the recombined second and third vapor stream and the third liquid stream in tower 54 are discharged through line 68 and are recovered as a product. In a specific embodiment, ethane and higher hydrocarbons discharged through line 68, as the fourth liquid stream, contain very little methane and substantially no nitrogen and are suitable for use as a feedstock for the manufacture of various chemicals, either with or without further separation. In order to maximize the separation attained in the plant and improve the efficiency thereof, the composite stream of the recombined second and the third vapor streams in line 52 may be cooled to a third reduced temperature sufficiently low to liquify a portion of the second and third vapor streams. This cooling stage may be carried out in indirect heat exchanger 70. The cooled second and third vapor streams are passed from heat exchanger 70 to line 72. The cooled vapor streams from line 72 may be subjected to a fifth separation step in separator 74 or may be passed directly to separator 54. In separator 74, the cooled second and third vapor streams are separated into a fifth liquid stream, which is passed through line 76, and a fifth vapor stream, which is passed through line 78. The fifth vapor stream, passing through line 78, may be passed through line 80 directly to the upper portion of separator 54 while the fifth liquid stream, passing through line 76, may be introduced into separator 54 below the point of introduction of the fifth vapor stream but above the point of introduction of the third liquid stream. By separately introducing the fifth vapor stream and the fifth liquid stream the vapors separating from the fifth liquid stream will rise through the column and contercurrently contact liquids separating from the fifth vapor stream, which are descending through the column. Preferably, such countercurrent contact is aided by an extended contact surface, which is preferably a packed section such as section 56. The efficiency of the separation, and the size and/or throughput of tower 54 can be still further improved and additional energy for in-plant use can be recovered by passing at least a portion of the fifth vapor stream through line 82 to a second expansion stage, in which it is expanded to a fifth elevated pressure substantially above atmospheric pressure but sufficiently low to liquefy a portion of the fifth vapor stream. Such expansion is carried out in expander portion 84E of turbo-expander compressor 84. The expanded portion of the fifth vapor stream from expander 84E is passed through line 86 and thence through line 80 to separator 54. To the extent that a portion of the fifth vapor stream is unexpanded it is passed through line 88 in order to bypass expander 84E and is then passed directly to tower 54 through line 80.

In order to effectively utilize the energy present in the cool fourth vapor stream, in line 64, this vapor stream may be utilized as an indirect heat exchange medium, in the third cooling stage, by passage through heat exchanger 70 and thereafter, in the second cooling stage, by passage through line 90 and thence through heat exchanger 20.

The first stage cooling of the feed gas may be carried out by a wide variety of combinations of cooling means. For example, the feed gas may be passed through line 92, through heat exchanger 94, thence through line 96, through heat exchanger 98, thereafter through line 100 and heat exchanger 102 and finally through line 104, through heat exchanger 106 and through line 108 to line 12. Heat exchangers 94 and 102 are preferably indirect heat exchangers in which the residue gas from separator 54 is utilized as a cooling medium. In this instance, the residue gas from heat exchanger 20 sequentially passes through line 110 to heat exchanger 102, thence through line 112 to heat exchanger 94 and then through line 114. In a still more preferred embodiment, heat exchangers 94 and 102 are used in combination with heat exchangers 98 and 106, which are supplied with an external refrigerant. Obviously, heat exchangers 98 and 106 may be utilized alone or in combination with additional heat exchangers, cooled by an external refrigerant, or in the combination, as shown with heat exchangers 94 and 102. Heat exchangers 98 and 106 are preferably tube and shell type heat exchangers, wherein the feed gas passes through the tubes of the heat exchangers while the refrigerant passes through the shell thereof. A still further improvement of the present invention can be effected by passing a portion of the feed gas from line 10 through line 116 and subjecting such portion to cooling by at least one reboil liquid collecting in tower 54. In the specific embodiment shown, the feed gas, through line 116, is first passed through heat exchanger 118, which is supplied with reboil liquid from a lower trapout tray 120 of tower 54 through lines 122 and 124, respectively. The feed gas from heat exchanger 118 can then be passed through line 126 to reboiler heat exchanger 128. Reboiler heat exchanger 128 is cooled by liquid in tower 54 from trapout tray 130, which is passed through lines 132 and 134, respectively. As previously indicated, plurality of side reboiler heat exchangers may be utilized in series. The cooled feed gas from heat exchanger 128 then passes through line 136, where it is combined with the cooled feed gas in line 108 and passed through line 12. The portion of the feed gas passing through line 116 may also be partially cooled by indirect heat exchange with the liquid product of tower 54 passing through line 68 in a heat exchanger (not shown) prior to its passage through heat exchanger 118.

The energy generated by turbo expanders 44E and 84E may be utilized to compress the residue gas by passing the residue gas from line 114 through compressor portion 44C of turbo-expander compressor 44, thence through line 138 to compressor portion 84C of turbo-expander compressor 84 and finally from compressor 84C to line 66.

The operation of the present invention and its advantages can be illustrated by a specific example.

For illustrative purposes, a natural gas feed having the following composition will be referred to.

| Component | Mole % |
|---|---|
| $CO_2$ | — |
| Nitrogen | 2.35 |
| $H_2S$ | — |
| Methane | 67.70 |
| Ethane | 15.21 |
| Propane | 10.41 |
| I-Butane | 0.89 |
| Butane | 2.34 |
| I-Pentane | 0.37 |
| Pentane | 0.41 |
| Hexane | 0.16 |
| Heptane | 0.07 |

By way of illustration the natural gas feed in this instance would be at a temperature at about 92° F. and a pressure of about 863 psia.

The following table illustrates the calculated temperatures and pressures at major points, as the feed gas passes through the system shown in the drawing.

| Line or Unit Number | Temperature °F. | Pressure psia |
|---|---|---|
| 12 | −30.0 | 830 |
| 22 | −62.9 | 825 |
| 16 | −30.0 | 830 |
| 26 | −62.9 | 825 |
| 28 | −62.9 | 825 |
| 46 | −101.9 | 475 |
| 38 | −55.0 | 475 |
| 40 | −76.0 | 470 |
| 74 | −115.4 | 470 |
| 76 | −115.4 | 470 |
| 78 | −115.4 | 470 |
| 86 | −156.0 | 235 |
| 54 Top | −154.2 | 235 |
| Bottom | 41.2 | 235 |

The composition of the fourth vapor stream or residue gas from column 54 passing through line 64 and the fourth liquid stream passing through line 68 would be as set forth below.

| Residue Gas Composition(64) | |
|---|---|
| Component | Mole % |
| $CO_2$ | — |
| Nitrogen | 3.32 |
| $H_2S$ | — |
| Methane | 95.04 |
| Ethane | 1.64 |
| Propane | 0.01 |
| I-Butane | Trace |
| Butane | Trace |
| I-Pentane | — |
| Pentane | — |
| Hexane | — |
| Heptane | — |

| Liquid Composition(68) | |
|---|---|
| Component | Mole % |
| $CO_2$ | — |

-continued

| Liquid Composition(68) | |
|---|---|
| Component | Mole % |
| Nitrogen | Trace |
| $H_2S$ | — |
| Methane | 1.45 |
| Ethane | 48.28 |
| Propane | 35.63 |
| I-Butane | 3.04 |
| Butane | 8.07 |
| I-Pentane | 1.28 |
| Pentane | 1.42 |
| Hexane | 0.57 |
| Heptane | Trace |

By way of comparison, the throughput of feed gas through the plant and particularly the throughput through tower 54 can be increased from about 75 MM SCF/D to about 88 MM SCF/D by operating in accordance with the system illustrated in the FIGURE, as compared with a conventionally operated two-expander system. Also, by operating in accordance with the method illustrated by the FIGURE, as opposed to conventional operation of a two-expander system, the volume of ethane retained in the fourth liquid stream, through line 68, can be increased from about 88.33 mole % to about 92.98 mole %. Finally, the horsepower output of expanders 44 and 84 can be increased by operation in accordance with the present invention as compared to a conventional two-expander system from about 484 Hp to 813 Hp.

While specific items of equipment, specific operations, specific materials and specific conditions of operation have been set forth herein for illustrative purposes, it is to be understood that these specifications are for illustrative purposes only and are not to be considered limiting.

We claim:

1. A method for separating higher boiling constituents from a normally gaseous feed mixture containing lower boiling constituents and said higher boiling constituents, at a temperature near atmospheric temperature and at a first elevated pressure substantially above atmospheric pressure, comprising:

(a) cooling said feed mixture, in a first cooling stage, to a first reduced temperature sufficiently low to liquefy a portion of said feed mixture;

(b) separating the thus cooled feed mixture, in a first separation step, into a first vapor stream and a first liquid stream;

(c) cooling said first vapor stream, in a second cooling stage, to a second reduced temperature sufficiently low to liquefy a portion of said first vapor stream;

(d) separating the thus cooled first vapor stream, in a second separation step, into a second vapor stream and a second liquid stream;

(e) reducing the pressure of said first liquid stream, in a first pressure reduction step, to a second elevated pressure substantially above atmospheric pressure but sufficiently low to flash a portion of said first liquid stream;

(f) reducing the pressure of said second liquid stream, in a second pressure reduction step, to a third elevated pressure substantially above atmospheric pressure and approximately equal to said second elevated pressure but sufficiently low to flash a portion of said second liquid stream;

(g) simultaneously separating the thus reduced-pressure, first liquid stream, in a lower portion of a third separation step, and the thus reduced-pressure, second liquid stream, in an upper portion of said third separation step, into a third vapor stream and a third liquid stream;

(h) expanding at least a portion of said second vapor stream, in an expansion stage, to a fourth elevated pressure substantially above atmospheric pressure and approximately equal to said second and said third elevated pressures but sufficiently low to liquefy a portion of said at least a portion of said second vapor stream;

(i) simultaneously separating the thus expanded at least a portion of said second vapor stream, the remaining portion, if any, of said second vapor stream and said third vapor stream, in an upper portion of a fourth separation step, and said third liquid stream, in a portion of said fourth separation step below said upper portion of said fourth separation step, into a fourth vapor stream, containing a substantially larger proportion of said lower boiling constituents than said feed mixture, and a fourth liquid stream, containing a substantially larger proportion of said higher boiling constituents than said feed mixture; and (j) collecting said fourth vapor stream and said fourth liquid stream, respectively, as products of said method.

2. A method in accordance with claim 1 wherein the thus expanded at least portion of the second vapor stream, the remaining portion, if any, of said second vapor stream and the third vapor stream are cooled, in a third cooling stage, to a third reduced temperature sufficiently low to liquefy portions of said expanded at least a portion of the second vapor stream, said remaining portion, if any, of said second vapor stream and said third vapor stream; the thus cooled said expanded at least a portion of said second vapor stream, said remaining portion, if any, of said second vapor stream and said third vapor stream are separated, in a fifth separation step, into a fifth liquid stream and fifth vapor stream, prior to separation in the fourth separation step, said fifth vapor stream is separated in an uppermost portion of the upper portion of said fourth separation step and said fifth liquid stream is separated in a lowermost portion of said upper portion of said fourth separation step above the portion of said further separation step at which the third liquid stream is separated.

3. A method in accordance with claim 2 wherein at least a portion of the fifth vapor stream is expanded, in a second expansion stage, to a fifth elevated pressure substantially above atmospheric pressure but sufficiently low to liquefy a portion of said at least a portion of said fifth vapor stream, prior to separation of its separation in the fourth separation step, and the thus expanded at least a portion of said fifth vapor stream and the remaining portion, if any, of said fifth vapor stream are separated in the upper most portion of the upper portion of said fourth separation step.

4. A method in accordance with claim 1 wherein liquids separated from the pressure-reduced, second liquid stream, in the third separation step, and vapors separated from the pressure-reduced, first liquid stream, in said third separation step, are passed over an extended contact surface, in said third separation step, and in countercurrent contact with each other while passing over said extended contact surface.

5. A method in acordance with claim 4 wherein the extended contact surface is a fluid-permeable packing.

6. A method in accordance with claim 1, 4 or 5 wherein the second cooling stage comprises passing the fourth vapor stream in indirect heat exchange with the first vapor stream.

7. A method in accordance with claim 2 or 3 wherein the third cooling stage comprises passing the fourth vapor stream in indirect heat exchange with the expanded at least a portion of the second vapor stream, the remaining portion, if any, of the second vapor stream and the third vapor stream and the second cooling stage comprises thereafter passing said fourth vapor stream in indirect heat exchange with the first vapor stream.

8. A method in accordance with claim 1, 4 or 5 wherein at least a portion of the cooling in the first cooling stage comprises passing the fourth vapor stream in indirect heat exchange with at least a portion of the normally gaseous feed mixture, in at least one sequential cooling step.

9. A method in accordance with claim 6 wherein at least a portion of the cooling in the first cooling stage comprises passing the fourth vapor stream in indirect heat exchange with at least a portion of the normally gaseous feed mixture, in at least one sequential cooling exchange step, after passing said fourth vapor stream in indirect heat exchange with the first vapor stream.

10. A method in accordance with claim 7 wherein at least a portion of the cooling in the first cooling stage comprises passing the fourth vapor stream in indirect heat exchange with at least a portion of the normally gaseous feed mixture, in at least one sequential cooling step, after passing said fourth vapor stream in indirect heat exchange with the first vapor stream.

11. A method in accordance with claim 8 wherein at least a second portion of the cooling in the first cooling stage comprises passing at least a portion of the normally gaseous feed mixture in indirect heat exchange with an external refrigerant.

12. A method in accordance with claim 1, 2, 3, 4 or 5 wherein the normally gaseous feed mixture is divided into two portions, a first portion of said two portions is passed in indirect heat exchange with at least one portion of the liquids separating in the fourth separation step and at least a portion of the cooling of the remaining, second portion of said two portions is cooled by passing the same in indirect heat exchange with the fourth vapor stream.

13. A method in accordance with claim 12 wherein the first portion of the two portions of the normally gaseous feed mixture is between about 30 mole % and about 50 mole % of the total of said normally gaseous feed mixture.

14. A method in accordance with claim 1 wherein the energy generated in the expansion stage is utilized to compress the fourth vapor stream prior to the collection of said fourth vapor stream as a product.

15. A method in accordance with claim 1 wherein the normally gaseous feed mixture is a natural gas containing methane and ethane and higher molecular weight hydrocarbons and a major portion of said methane is collected as the fourth vapor stream and a major portion of said ethane and higher molecular weight hydrocarbons is collected as the fourth liquid stream.

16. Apparatus for separating higher boiler constituents from a normally gaseous feed mixture containing lower boiling constituents and said higher boiling constituents, at a temperature near atmospheric temperature and at a first elevated pressure substantially above atmosphermic pressure, comprising:

(a) first cooling means adapted to cool said normally gaseous feed mixture to a first reduced temperature sufficiently low to liquefy a portion of said feed mixture;

(b) first separating means adapted to receive the thus cooled normally gaseous feed mixture and separate said cooled normally gaseous feed mixture into a first vapor stream and a first liquid stream;

(c) second cooling means adapted to cool said first vapor stream to a second reduced temperature sufficiently low to liquefy a portion of said first vapor stream;

(d) second separating means adapted to receive the thus cooled first vapor stream and separate said cooled, first vapor stream into a second vapor stream and a second liquid stream;

(e) first pressure reducing means adapted to reduce the pressure of said first liquid stream to a second elevated pressure substantially above atmospheric pressure but sufficiently low to flash a portion of said first liquid stream;

(f) second pressure reducing means adapted to reduce the pressure of said second liquid stream to a third elevated pressure substantially above atmospheric pressure and approximately equal to said second elevated pressure but sufficiently low to flash a portion of said second liquid stream;

(g) third separating means adapted to simultaneously receive the thus reduced-pressure, first liquid stream, in a lower portion of said third separating means, and receive the thus reduced-pressure, second liquid stream, in an upper portion of said third separating means, and to simultaneously separate the thus received reduced-pressure, first liquid stream and the thus received reduced-pressure, second liquid stream into a third vapor stream and a third liquid stream;

(h) first expansion means adapted to expand at least a portion of said second vapor stream to a fourth elevated pressure substantially above atmospheric pressure and approximately equal to said second and said third elevated pressures but sufficiently low to liquefy a portion of said at least a portion of said second vapor stream;

(i) fourth separating means adapted to simultaneously receive the thus expanded at least a portion of the second vapor stream, the remaining portion, if any, of the second vapor stream and said third vapor stream in an upper portion thereof, and said third liquid stream in a portion thereof below said upper portion thereof and to simultaneously separate said expanded at least a portion of said second vapor stream, said remaining portion, if any, of said second vapor stream, said third vapor stream and said third liquid stream into a fourth vapor stream and a fourth liquid stream;

(j) means for collecting said fourth vapor stream as a product; and (k) means for collecting said fourth liquid stream as a product.

17. Apparatus in accordance with claim 16 in which additionally includes a third cooling means adapted to cool the thus expanded at least a portion of the second vapor stream, the remaining portion, if any, of the second vapor stream and the third vapor stream to a third reduced temperature sufficiently low to liquefy a portion of said expanded at least a portion of said second vapor stream, said remaining portion, if any, of said second vapor stream and said third vapor stream and a fifth separation means adapted to receive the thus cooled expanded at least a portion of said second vapor stream, said remaining portion, if any, of said second vapor stream and separate said expanded at least a portion of said second vapor stream, said remaining portion, if any, of said second vapor stream and said third vapor stream into a fifth vapor stream and a fifth liquid stream, and the fourth separating means is adapted to receive said fifth vapor stream in an uppermost portion of the upper portion of said fourth separation means and to receive said fifth liquid stream in a lowermost portion of said upper portion of said fourth separation means located above the portion of the fourth separation means at which the third liquid stream is received.

18. Apparatus in accordance with claim 17 which additionally includes second expansion means adapted to receive at least a portion of the fifth vapor stream and expand said at least a part of said fifth vapor stream to a fifth elevated pressure substantially above atmospheric pressure but sufficiently low to liquefy a portion of said at least a portion of said fifth vapor stream and the fourth separation means is adapted to receive the thus expanded at least a portion of the fifth vapor stream and the remaining portion, if any, of the fifth vapor stream in the uppermost portion of the upper portion of said fourth separation step.

19. Apparatus in accordance with claim 16 wherein the third separation means includes an extended contact surface between the point of reception of the reduced pressure first liquid stream and the point of reception of the reduced pressure second liquid stream.

20. Apparatus in accordance with claim 19 wherein the extended contact surface is a fluid-permeable packing means.

21. Apparatus in accordance with claim 16, 19 or 20 wherein the second cooling means is adapted to pass the fourth vapor stream in indirect heat exchange with the first vapor stream.

22. Apparatus in accordance with claim 17 or 18 wherein the third cooling means is adapted to pass the fourth vapor stream in indirect heat exchange with the expanded at least a portion of the second vapor stream, the remaining portion, if any, of the second vapor stream and the third vapor stream, and the second cooling means is adapted to pass the fourth vapor stream in indirect heat exchange with the first vapor stream after said passage of said fourth vapor stream through said third cooling means.

23. Apparatus in accordance with claim 16 wherein the first cooling means includes at least one heat exchange means adapted to pass said fourth vapor stream in indirect heat exchange with at least a portion of the normally gaseous feed mixture.

24. Apparatus in accordance with claim 23 wherein the first cooling means additionally includes at least one additional heat exchange means adapted to pass an external refrigerant in indirect heat exchange with the normally gaseous feed mixture.

25. Apparatus in accordance with claim 16 wherein the first cooling means includes at least one heat exchange means adapted to pass at least a portion of the normally gaseous feed mixture in indirect heat exchange with a portion of liquids separating in the fourth separator means.

26. Apparatus in accordance with claim 16 wherein the expander means is an expander portion of a turbo expander-compressor means.

27. Apparatus in accordance with claim 26 wherein the compressor portion of the turbo expander-compressor means is adapted to compress the fourth vapor stream prior to collection of said fourth vapor stream by the means for collecting said fourth vapor stream as a product.

28. Apparatus in accordance with claim 24 wherein the first and the second expansion means are expander portions of a first and a second turbo expander-compressor, respectively.

29. Apparatus in accordance with claim 28 wherein the compressor portions of the first and second turbo expander-compressors are adapted to sequentially compress said fourth vapor prior to the collection of said fourth vapor stream by the means for collecting said fourth vapor stream as a product.

* * * * *

UNITED STATES PATENT AND TRADEMARK OFFICE

CERTIFICATE OF CORRECTION

PATENT NO. : 4,322,225

DATED : March 30, 1982

INVENTOR(S) : Michael L. Gray, Robert M. Bellinger

It is certified that error appears in the above-identified patent and that said Letters Patent are hereby corrected as shown below:

Col. 9, Claim 2, line 49 change "further" to ---fourth---
Col. 11, Claim 17, line 64 delete "in", second occurrence Signed and Sealed this

*Twenty-fourth* Day of *August 1982*

[SEAL]

*Attest:*

GERALD J. MOSSINGHOFF

*Attesting Officer*

*Commissioner of Patents and Trademarks*